US011767734B2

(12) United States Patent
Al-Dossary

(10) Patent No.: US 11,767,734 B2
(45) Date of Patent: Sep. 26, 2023

(54) OFF BOTTOM CEMENTING SYSTEM

(71) Applicant: SAUDI ARABIAN OIL COMPANY, Dhahran (SA)

(72) Inventor: Mohammed Jaber Al-Dossary, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 53 days.

(21) Appl. No.: 17/400,771

(22) Filed: Aug. 12, 2021

(65) Prior Publication Data

US 2023/0046556 A1 Feb. 16, 2023

(51) Int. Cl.

| | |
|---|---|
| ***E21B 33/16*** | (2006.01) |
| ***E21B 34/10*** | (2006.01) |
| ***E21B 34/14*** | (2006.01) |
| ***E21B 17/14*** | (2006.01) |

(52) U.S. Cl.

CPC ..... *E21B 33/165* (2020.05); *E21B 17/14* (2013.01); *E21B 33/16* (2013.01); *E21B 34/103* (2013.01); *E21B 34/142* (2020.05)

(58) Field of Classification Search

CPC ..... E21B 17/14; E21B 33/126; E21B 33/136; E21B 33/16; E21B 33/165; E21B 34/103; E21B 34/14; E21B 34/142

See application file for complete search history.

(56) References Cited

U.S. PATENT DOCUMENTS 3,131,767 A * 5/1964 Chancellor et al. .. E21B 33/136 166/156
3,527,299 A * 9/1970 Lewis ..... E21B 33/14 166/184
3,948,322 A * 4/1976 Baker ..... E21B 33/127 166/187
4,296,808 A 10/1981 Baker et al.
4,469,174 A * 9/1984 Freeman ..... E21B 33/14 166/317
4,655,286 A 4/1987 Wood
5,544,705 A 8/1996 Jones et al.
5,732,775 A * 3/1998 Hudson et al. ..... E21B 17/043 166/290
6,668,923 B2 12/2003 Vincent et al.
6,739,391 B2 * 5/2004 McMahan ..... E21B 33/134 166/291
6,868,906 B1 3/2005 Vail, III et al.

(Continued)

FOREIGN PATENT DOCUMENTS

CN 105822252 B 9/2018
EP 2469017 A1* 6/2012 .....E21B 33/1216

(Continued)

OTHER PUBLICATIONS

Rogers et al.; "Off-Bottom Cementing Process Used Successfully With Conventional Liner-Hanger Systems With Newly Designed Selective-Release-Plug Assemblies", AADE 2009NTCE11-01; American Association of Drilling Engineers; Nov. 1, 2009 (11 pages).

*Primary Examiner* — Jennifer H Gay
(74) *Attorney, Agent, or Firm* — Osha Bergman Watanabe & Burton LLP

(57) ABSTRACT

A method includes setting a tubular above a bottom of the well. The tubular having a float shoe attached to a distal end of the tubular and a controllable port penetrating a wall of the float shoe. The method further includes isolating a section of the annulus, opening the controllable port, and pumping cement through the controllable port into the section of the annulus to cement the annulus of the well.

7 Claims, 11 Drawing Sheets

(56) References Cited

U.S. PATENT DOCUMENTS

| | | | | |
|---|---|---|---|---|
| 10,443,342 | B2* | 10/2019 | Eidem et al. | E21B 33/127 |
| 11,203,911 | B1* | 12/2021 | Rogers et al. | E21B 33/13 |
| 2008/0251253 | A1 | 10/2008 | Lumbye | |
| 2010/0314134 | A1* | 12/2010 | Nutley et al. | E21B 33/1208 166/131 |
| 2012/0048551 | A1* | 3/2012 | Allison et al. | E21B 33/1208 166/292 |
| 2012/0175134 | A1* | 7/2012 | Robisson et al. | E21B 33/1208 166/135 |
| 2017/0130536 | A1* | 5/2017 | Stam et al. | E21B 33/1204 |
| 2018/0163502 | A1* | 6/2018 | Eidem et al. | E21B 23/06 |
| 2019/0078408 | A1* | 3/2019 | Fripp | E21B 23/06 |
| 2020/0063524 | A1 | 2/2020 | Giroux | |
| 2021/0025259 | A1 | 1/2021 | Al-Mousa et al. | |
| 2021/0032958 | A1* | 2/2021 | Saraya et al. | E21B 33/14 |

FOREIGN PATENT DOCUMENTS

| | | | |
|---|---|---|---|
| WO | 2022193024 | A1* | 9/2022 |

* cited by examiner

OFF BOTTOM CEMENTING SYSTEM

BACKGROUND

In the petroleum industry, wells are drilled into the surface of the Earth to access and produce hydrocarbons. The process of building a well is often split into two parts: drilling and completion. Drilling a well may include using a drilling rig to drill a hole into the ground, trip in at least one string of casing, and cement the casing string in place. The casing string is used to define the structure of the well, provide support for the wellbore walls, and prevent unwanted fluid from being produced. The casing string is cemented in place to prevent formation fluids from exiting the formation and provide further structure for the well.

After a casing string has been placed in the well, the annulus located between the casing string and the wellbore wall must be cemented completely (i.e., to surface) or partially. This is done by pumping cement from the surface, through the inside of the casing string, and up the outside of the casing string (the annulus) to the required height. Oftentimes, the slurry of cement is followed by another type of fluid and/or a wiper plug to push the remainder of the cement out of the inside of the casing and into the annulus, leaving a small amount of cement inside of the casing string. The cement is left to harden before the next section of the well is drilled or the well is completed.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present invention presents, in one or more embodiments, apparatuses and methods for off-bottom cementing of a tubular in a well. In one embodiment, the apparatus includes a float shoe attached to a distal end of the tubular, a controllable port penetrating a wall of the float shoe, and a sleeve mounted at a position, below the controllable port, on an exterior surface of the float shoe. The sleeve is pushed into a wellbore in response to an activation signal to isolate an annulus. The controllable port has an open position that allows cement to be pumped from an inside of the tubular to the annulus to cement the tubular in place.

In another embodiment, the apparatus includes a float shoe attached to a distal end of the tubular, a controllable port penetrating a wall of the float shoe, and an expandable packer mounted at a position on an exterior surface of the float shoe, below the controllable port. The expandable packer expands when exposed to a chemical activation signal. The controllable port has an open position that allows cement to be pumped from an inside of the tubular to an annulus of the tubular to cement the tubular in place.

The method includes setting a tubular above a bottom of the well. The tubular having a float shoe attached to a distal end of the tubular and a controllable port penetrating a wall of the float shoe. The method further includes isolating a section of the annulus, opening the controllable port, and pumping cement through the controllable port into the section of the annulus to cement the annulus of the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

After a hole section has been drilled, a string of casing is run into a well to a planned target depth. This target depth is usually at the "bottom" of the hole section (i.e., anywhere from 3 - 10 feet off of the bottom-most portion of the drilled wellbore). However, there are multiple scenarios that prevent the casing from being run to the target depth. These scenarios include running into an obstacle while running in hole, drilling past the planned target depth, missing the planned target depth due to formation uncertainties, etc.

When a string of casing cannot be run to the target depth (i.e., "bottom"), the casing string is considered to be "off bottom" (i.e., the casing string's deepest point is greater than 10 ft away from the bottom-most portion of the drilled wellbore). In this scenario, the casing must still be cemented in place as normal. As such, FIG. 1 shows a conventional off bottom cementing system in accordance with one or more embodiments.

Figure 1:
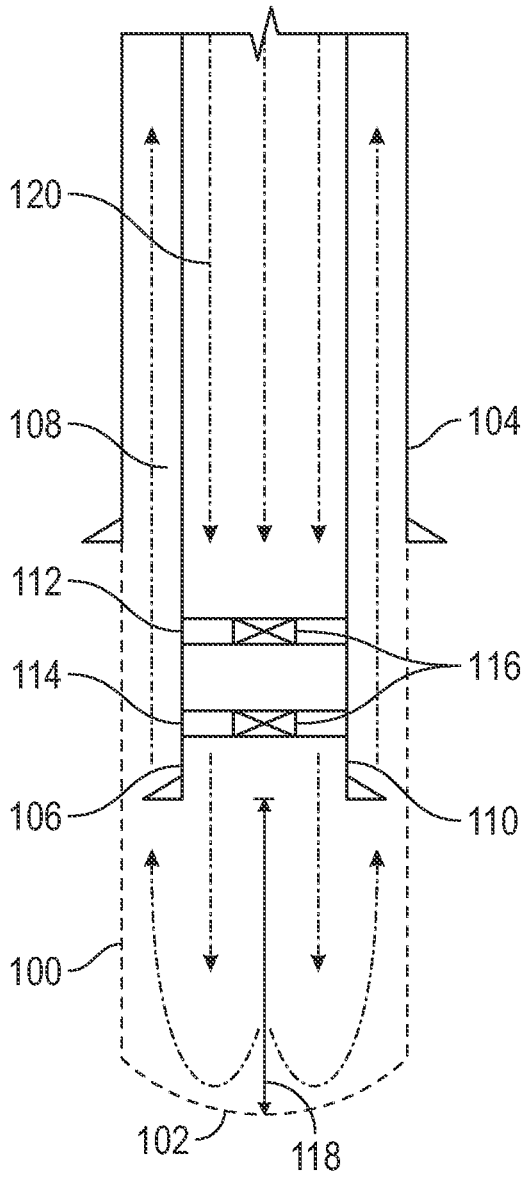
FIG. 1 shows a conventional off-bottom cementing system in accordance with one or more embodiments.

The conventional off bottom cementing system depicted in FIG. 1 is a well that includes a wellbore (100). The wellbore (100) is a hole drilled into the surface of the Earth. The wellbore (100) has a bottom (102) defined by the deepest-most point (within the Earth) that the wellbore (100) reaches. A first casing string (104) has been run in hole and cemented in place prior to the current wellbore (100) having been drilled. The current wellbore (100) is drilled which includes drilling out the casing shoe accessories of the first casing string (104) and drilling a new hole into the rock. After the wellbore (100) has been drilled, a second casing string (106) is run into the well and set off bottom (102) as shown in FIG. 1.

The second casing string (106) is a tubular made of a material that can withstand downhole temperatures and pressures, such as steel. The second casing string (106) has an annulus (108) located between the outer surface of the second casing string (106) and the inner surface of the wellbore (100). The annulus (108) is also located between the outer surface of the second casing string (106) and the inner surface of the first casing string (104). The second casing string (106) has a distal end (110). The distal end (110) is the end of the second casing string (106) closest to the bottom (102).

The second casing string (106) further includes a float collar (112) and a float shoe (114). The float shoe (114) is attached to the distal end (110) of the second casing string (106). The float shoe (114) may have a rounded profile that helps the second casing string (106) be tripped into the wellbore (100). The float shoe (114) has a float valve (116) on the inside of the float shoe (114). The float valve (116) is an integral check valve that allows fluid to flow in one direction within the second casing string (106), the direction being from the surface to the distal end (110). The float valve (116) prevents reverse flow of fluid or U-tubing of fluid from entering the inside of the second casing string (106).

The float shoe (114) may also include profiles for cement plugs to seat in when performing a one or two plug cementing operation. The external portion of the float shoe (114) may be made of the same material as the second casing string (106) and the inside components may be made of cement or thermoplastic, because this material must be drilled out, if the well is to be deepened beyond the second casing string (106). The float collar (112) is located above the float shoe (114) along the distal end (110) of the second casing string (106). The float collar (112) may also have a float valve (116) to act as a redundancy. The float collar (112) may also have profiles for cement plugs to seat in, and the float collar (112) may be made of the same materials as the float shoe (114).

The space between the distal end (110) of the second casing string (106) and the bottom (102) of the wellbore (100) is called the open hole (118). The open hole (118) is at least 50 feet long when the second casing string (106) has been set off bottom (102), as shown in FIG. 1. When the second casing string (106) is cemented, cement (120) is pumped through the inside of the second casing string (106) and into the open hole (118). The open hole (118) must fill completely up with cement (120) before the cement (120) begins to fill the annulus (108).

Cementing an off bottom (102) string of casing requires a much larger volume of cement (120) than would be required if the second casing string (106) had been set at the bottom (102) of the wellbore (100). Further, the entirety of the open hole (118) will be filled with hardened cement (120) that must be drilled out before the well can be deepened and/or put on production. Therefore, systems and methods that allow a casing string, which has been set off bottom (102), to be cemented without having to completely fill up the open hole (118) are beneficial.

As such, embodiments disclosed herein present systems that may be put in place to allow a casing string to be cemented at any depth regardless of the bottom (102) of the wellbore (100). These systems help prevent the cement (120) from entering the open hole (118), beneath the casing string, and may act as a contingency when a casing string cannot be set at the bottom (102) of the wellbore (100). FIGS. 2*a* - 7*c* present such systems and FIG. 8 presents a flowchart outlining a method of utilizing such systems.

FIGS. 2*a* - 2*d* show an apparatus for off bottom (102) cementing a tubular. Components shown in FIGS. 2*a* - 2*d* that are the same or similar to components shown in FIG. 1 have not been redescribed for purposes of readability and have the same description and function as described above. The tubular to be cemented is shown as the second casing string (106) but may be any tubular that has been set off bottom (102).

The second casing string (106) has a controllable port (200) penetrating a wall of the float shoe (114). There may be more than one controllable port (200). The controllable port (200) may have a closed position and an open position. The closed position means that there is no fluid communication between the inside of the second casing string (106) and the annulus (108). The open position means that there is fluid communication between the inside of the second casing string (106) and the annulus (108).

The second casing string (106) also has a sleeve (202) mounted at a position, below the controllable port (200), on an exterior surface of the float shoe (114). The sleeve (202) is configured to move from a first position to a second position. The first position allows fluid communication between the annulus (108) and the open hole (118), the second position isolates the annulus (108) from the open hole (118). The second position occurs when the sleeve (202) is pushed into the wellbore (100) in response to an activation signal.

The sleeve (202) may be made of a metallic material. The sleeve (202) is formed in a rounded shape when in the second position. When the sleeve (202) is pushed into the wellbore (100), the sleeve (202) cuts through the rock and is able to be hung off from the rock. The sleeve (202) fills the space in the annulus (108) such that fluid is prevented from going from the annulus (108) to the open hole (118).

The second casing string (106) also has a ball seat (204) fixed within the float shoe (114) and located between the sleeve (202) and the controllable port (200), wherein the ball seat (204) is configured to receive a ball (206), and, upon reception of the ball (206), fluid is unable to pass through the ball seat (204). The ball seat (204) may be a float valve (116). The ball (206) may be sized to be able to fit through the float valve (116) on the float collar (112) yet not pass through/sit on the float valve (116)/ball seat (204) located in the float shoe (114).

Figure 2A:
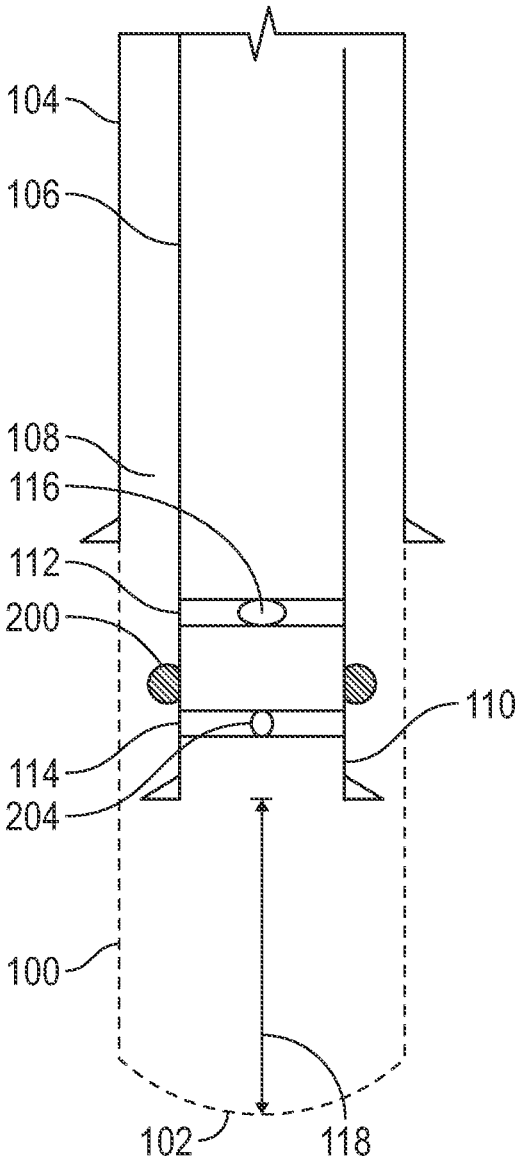
FIGS. 2*a* - 2*d* show an apparatus in accordance with one or more embodiments.

FIG. 2*a* shows the second casing string (106) set off bottom (102). The second casing string (106) has the float collar (112) and the float shoe (114). The float shoe (114) is shown with the controllable port (200) in the closed position and the sleeve (202) is not pictured as it is in the first position. The float shoe (114) is also shown having the ball seat (204) with no ball (206) in the ball seat (204) meaning that fluid is free to be pumped from the inside of the second casing string (106) to the open hole (118).

Figure 2B:
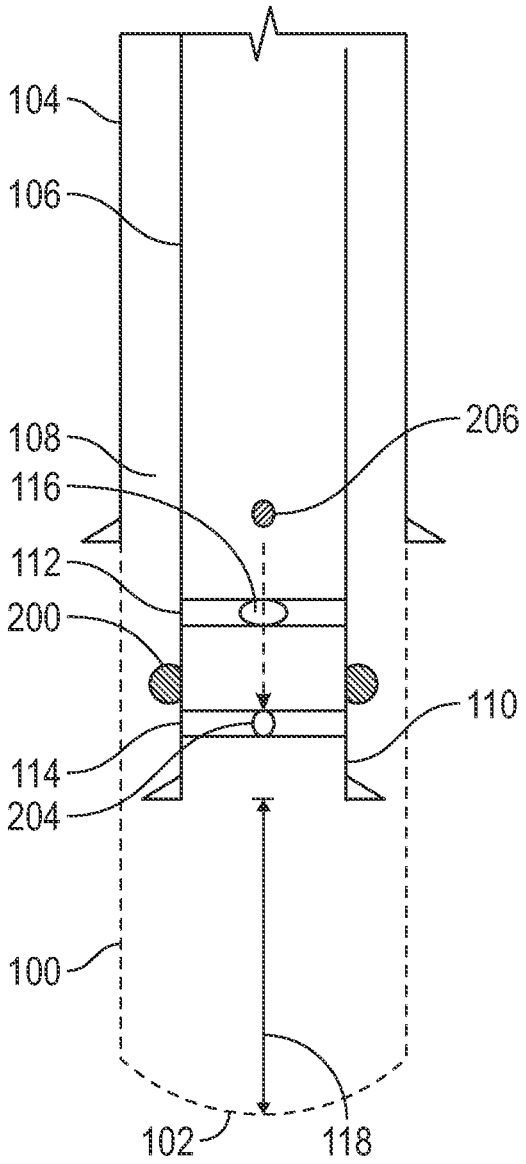
Figure 2C:
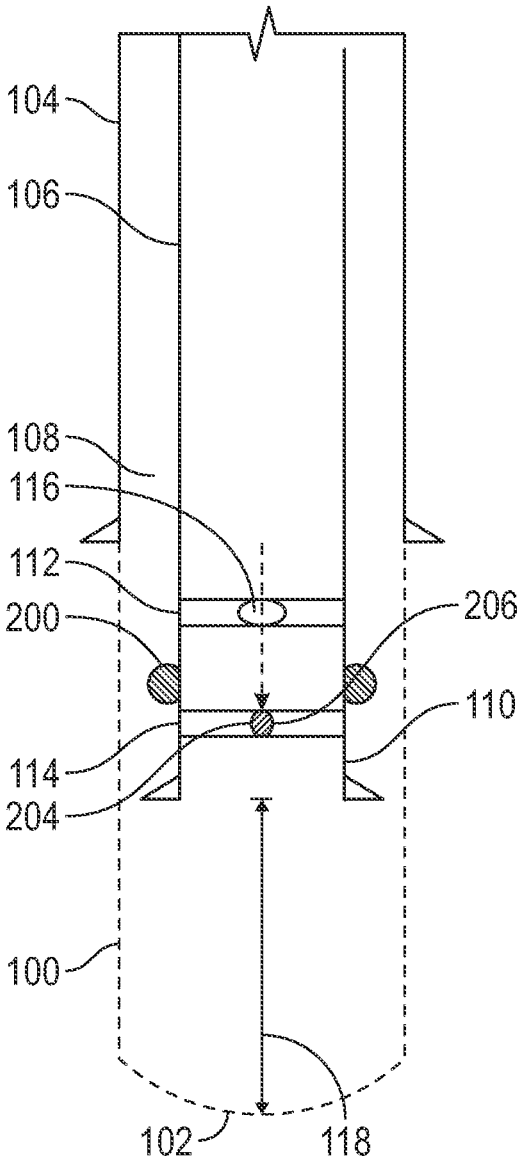

FIG. 2*b* shows a ball (206) being pumped though the inside of the second casing string (106). FIG. 2*c* shows the ball (206) being received and set into the ball seat (204). Once the ball (206) is received in the ball seat (204), fluid pumped into the second casing string (106) has nowhere to go so pressure builds up within the second casing string (106). The activation signal that may push the sleeve (202) into the wall of the wellbore (100) includes a first predetermined pressure being reached by pumping fluid into the second casing string (106) while the ball (206) is in the ball seat (204).

Figure 2D:
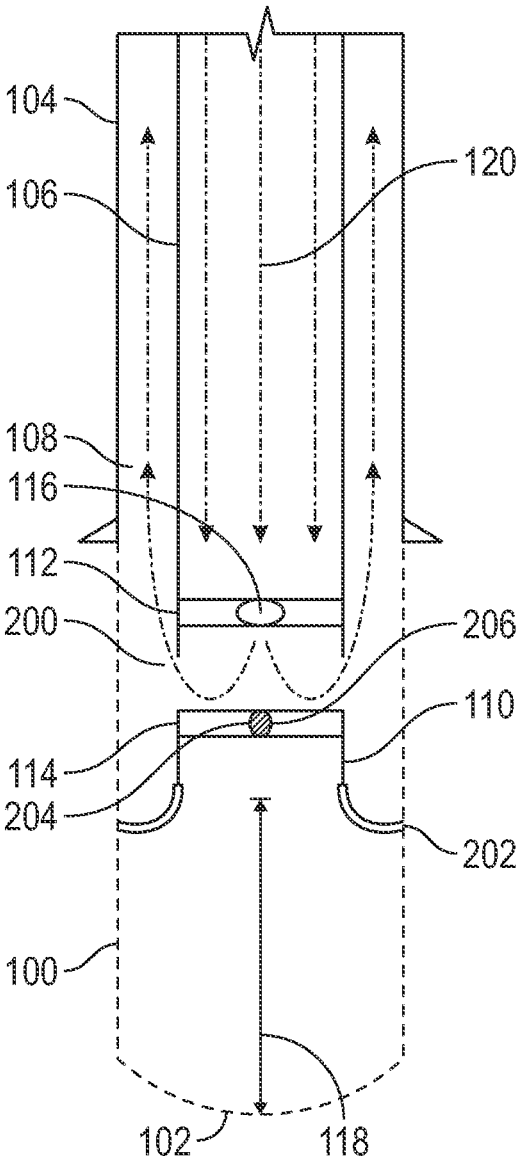

When the first predetermined pressure is reached, the sleeve (202) may move to the second position as shown in FIG. 2*d*. As the pressure continues to build on top of the ball (206), a second predetermined pressure is reached. This second predetermined pressure shears shear pins (not pictured) located in the controllable port (200). The shearing of the shear pins places the controllable port (200) in the open position and a hydraulic flow path is created between the inside of the second casing string (106) and the annulus (108). Circulation of fluid may be established to confirm that the controllable port (200) is opened.

FIG. 2*d* shows the apparatus after the first and the second predetermined pressures have been reached and the controllable port (200) is open, and the sleeve (202) is in the second position. At this point, cement (120) may be pumped into the second casing string (106), out of the open controllable port (200) and into the annulus (108). A plug (not pictured) may follow the cement (120) slurry to wipe the cement out of the inside of the second casing string (106). The plug may latch in the float collar (112) or the float shoe (114) to cover the open controllable port (200).

FIGS. 3*a* - 3*d* show an apparatus for off bottom (102) cementing a tubular. Components shown in FIGS. 3*a* - 3*d* that are the same or similar to components shown in FIGS. 1 - 2*d* have not been redescribed for purposes of readability and have the same description and function as described above. The tubular to be cemented is shown as the second casing string (106) but may be any tubular that has been set off bottom (102).

Figure 3A:
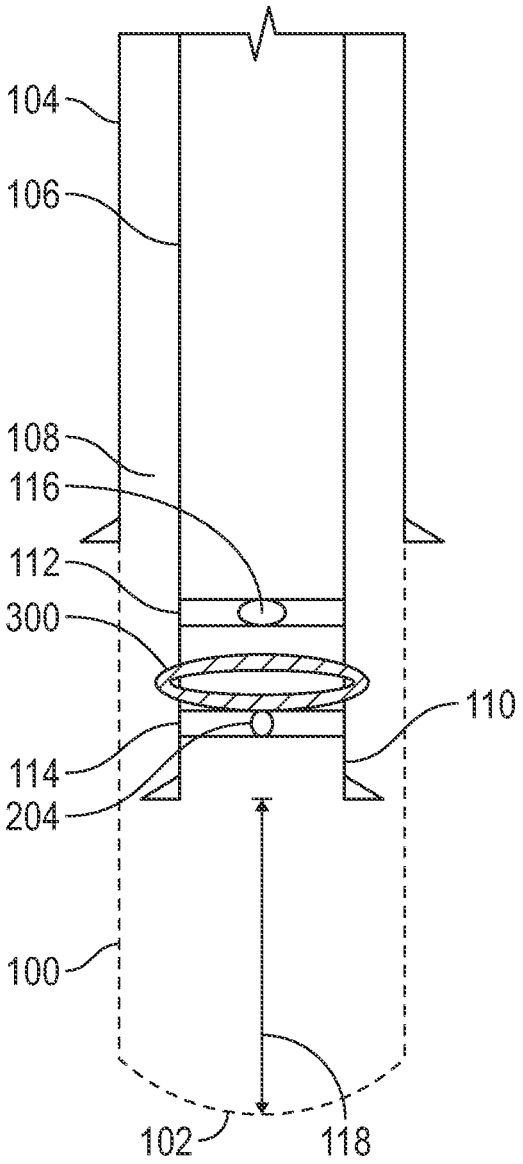
FIGS. 3*a* - 3*d* show an apparatus in accordance with one or more embodiments.

FIG. 3*a* shows the second casing string (106) set off bottom (102). The second casing string (106) has the float collar (112) and the float shoe (114). The float shoe (114) is shown with the controllable port (200) as a dissolvable ring (300). The dissolvable ring (300) is in the closed position and the sleeve (202) is not pictured as it is in the first position. The float shoe (114) is also shown having the ball seat (204) with no ball (206) in the ball seat (204) meaning that fluid is free to be pumped from the inside of the second casing string (106) to the open hole (118). The dissolvable ring (300) is made of a material that dissolves when exposed to a chemical activation signal. The chemical activation signal may be the presence of a chemical (302). The chemical (302) may be any chemical known in the art that may cause a material dissolve.

Figure 3B:
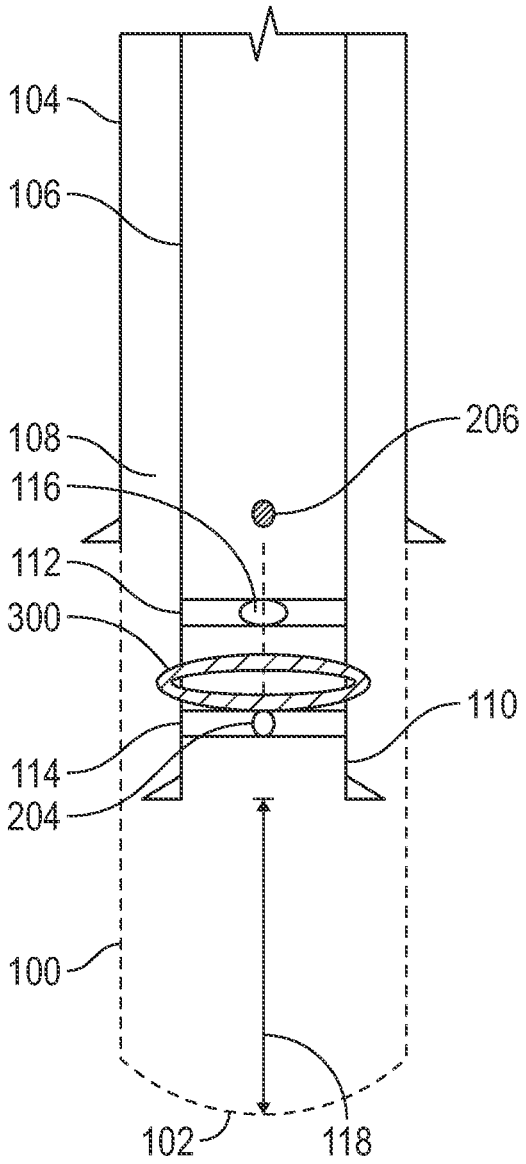
Figure 3C:
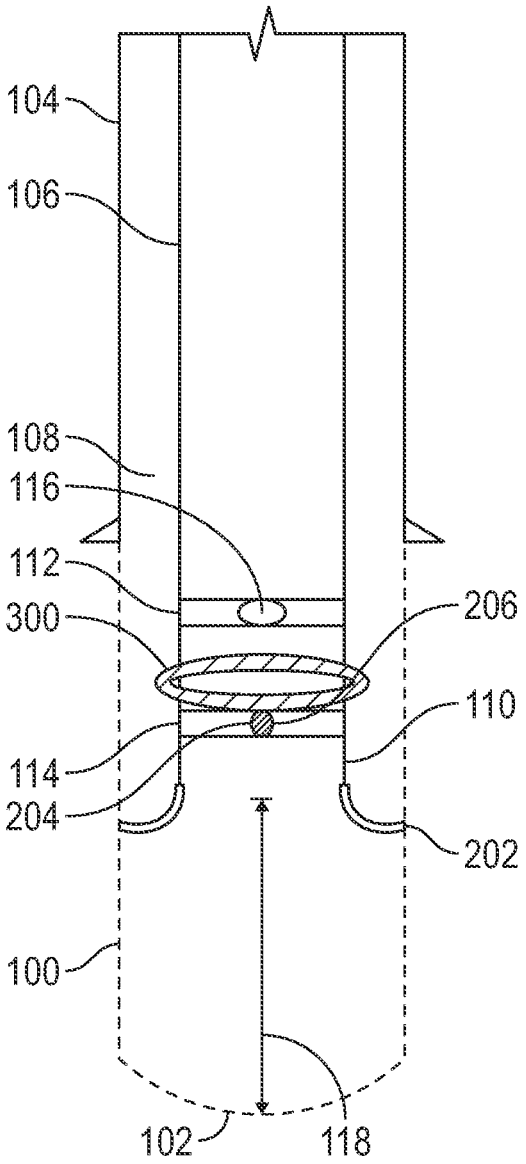

FIG. 3*b* shows a ball (206) being pumped though the inside of the second casing string (106). FIG. 3*c* shows the ball (206) received and set into the ball seat (204). Once the ball (206) is received in the ball seat (204), fluid pumped into the second casing string (106) has nowhere to go so pressure builds up within the second casing string (106). The activation signal that may push the sleeve (202) into the wall of the wellbore (100) includes a first predetermined pressure being reached by pumping fluid into the second casing string (106) while the ball (206) is in the ball seat (204). When the first predetermined pressure is reached, the sleeve (202) may move to the second position as shown in FIG. 3*c*.

Figure 3D:
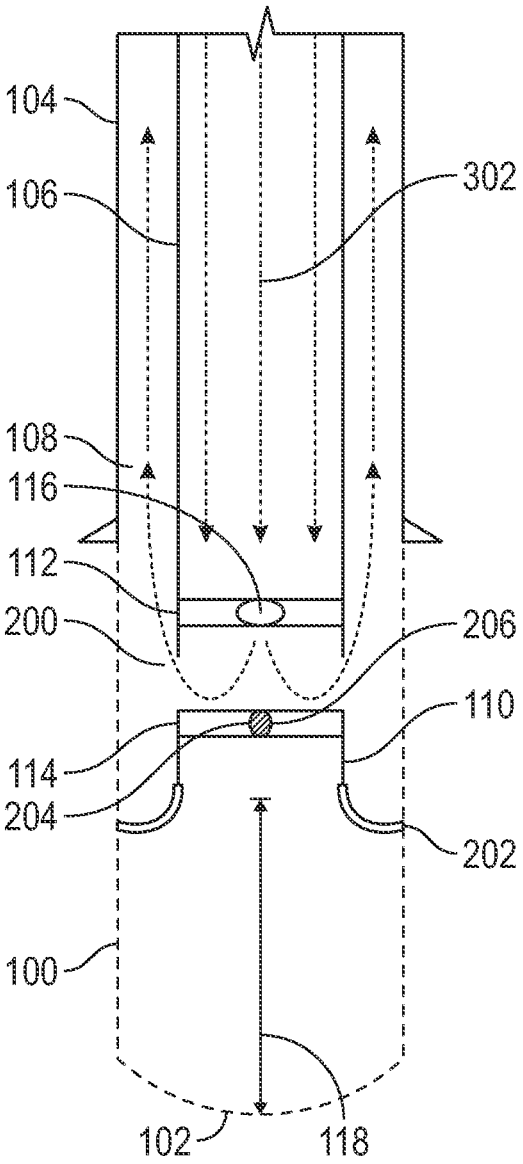

FIG. 3*d* shows the chemical (302) activation signal after being deployed. The chemical (302) activation signal includes pumping a chemical (302) into the second casing string (106). The chemical dissolves the dissolvable ring (300) to put the controllable port (200) in the open position. Therefore, FIG. 3*d* shows the apparatus after the first predetermined pressure has been reached and the controllable port (200) is open creating a hydraulic flow path between the inside of the second casing string (106) and the annulus. The sleeve (202) is shown in the second position. At this point, cement (120) may be pumped into the second casing string (106), out of the open controllable port (200) and into the annulus (108). A plug (not pictured) may follow the cement (120) slurry to wipe the cement out of the inside of the second casing string (106). The plug may latch in the float collar (112) or the float shoe (114) to cover the open controllable port (200).

Figure 4A:
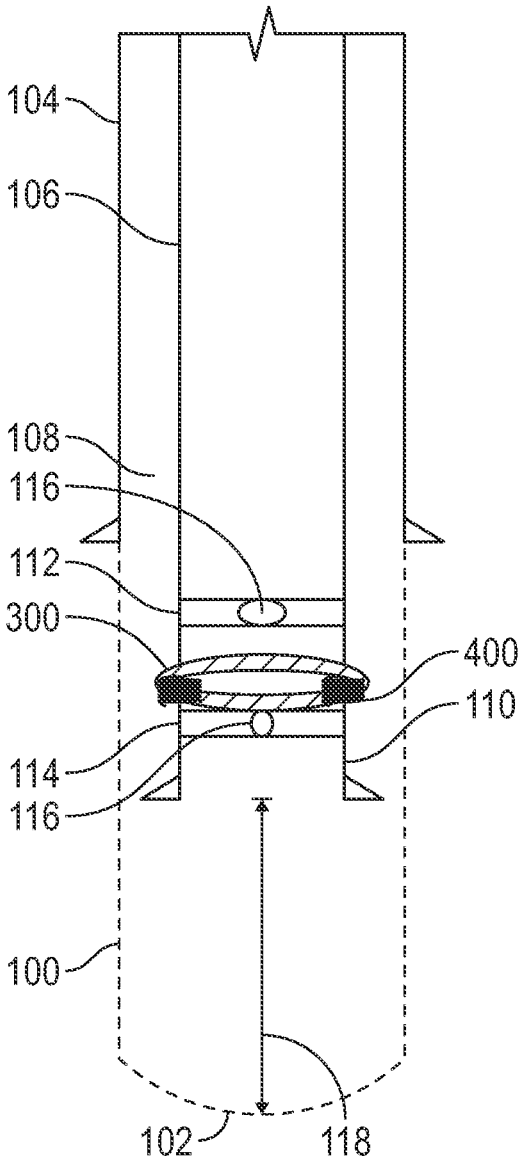
FIGS. 4*a* - 4*b* show an apparatus in accordance with one or more embodiments.
Figure 4B:
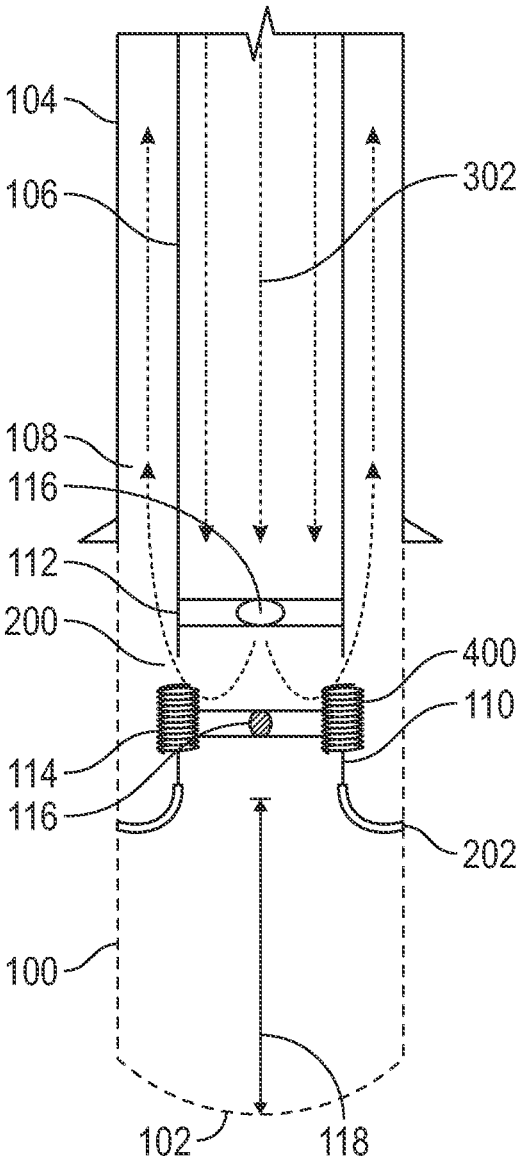

FIGS. 4*a* - 4*b* show an apparatus for off bottom (102) cementing a tubular. Components shown in FIGS. 4*a* - 4*b* that are the same or similar to components shown in FIGS. 1 - 3*d* have not been redescribed for purposes of readability and have the same description and function as described above. The tubular to be cemented is shown as the second casing string (106) but may be any tubular that has been set off bottom (102).

FIG. 4*a* shows the second casing string (106) set off bottom (102). The second casing string (106) has the float collar (112) and the float shoe (114). The float shoe (114) is shown with the controllable port (200) having a dissolvable ring (300). The float shoe (114) further includes a float valve (116). The dissolvable ring (300) is in the closed position. The sleeve (202) has at least two springs (400). The springs (400) are used to place the sleeve (202) in the second position. The springs (400) begin compressed and, once the dissolvable ring (300) is dissolved, the springs (400) are expanded thus pushing the sleeve (202) downward into the formation/wellbore (100).

The dissolvable ring (300) is made of a material that dissolves when exposed to a chemical activation signal. The chemical activation signal may be the presence of a chemical (302). The chemical (302) may be any chemical known in the art that may cause a material dissolve. FIG. 4*b* shows a chemical (302) activation signal being deployed. The chemical (302) activation signal may include pumping a chemical (302) into the second casing string (106).

The chemical (302) is free to be pumped to the float shoe (114) due to the float valve (116) allowing fluid to pass from the inside of the second casing string (106) to the open hole (118). The chemical (302) dissolves the dissolvable ring (300) to put the controllable port (200) in the open position. The chemical (302) also activates the float shoe (114) to block the float shoes' (114) float valve (116) such that no more fluid may pass through the float valve (116). The controllable port (200) being in the open position creates a hydraulic flow path between the inside of the second casing string (106) and the annulus (108).

The activation signal that places the sleeve (202) in the second position may be the dissolvable ring (300) being dissolved. The springs (400) of the sleeve (202) respond to the activation signal (i.e., the dissolvable ring (300) being dissolved) to push the sleeve (202) into the wellbore (100). The sleeve (202) is shown in the second position and the controllable port (200) is shown in the open position in FIG. 4*c*. At this point, cement (120) may be pumped into the second casing string (106), out of the open controllable port (200) and into the annulus (108). A plug (not pictured) may follow the cement (120) slurry to wipe the cement (120) out of the inside of the second casing string (106). The plug may latch in the float collar (112) or the float shoe (114) to cover the open controllable port (200).

FIGS. 5*a* - 5*d* show an apparatus for off bottom (102) cementing a tubular. Components shown in FIGS. 5*a* - 5*d* that are the same or similar to components shown in FIGS. 1 - 4*b* have not been redescribed for purposes of readability and have the same description and function as described above. The tubular to be cemented is shown as the second casing string (106) but may be any tubular that has been set off bottom (102).

Figure 5A:
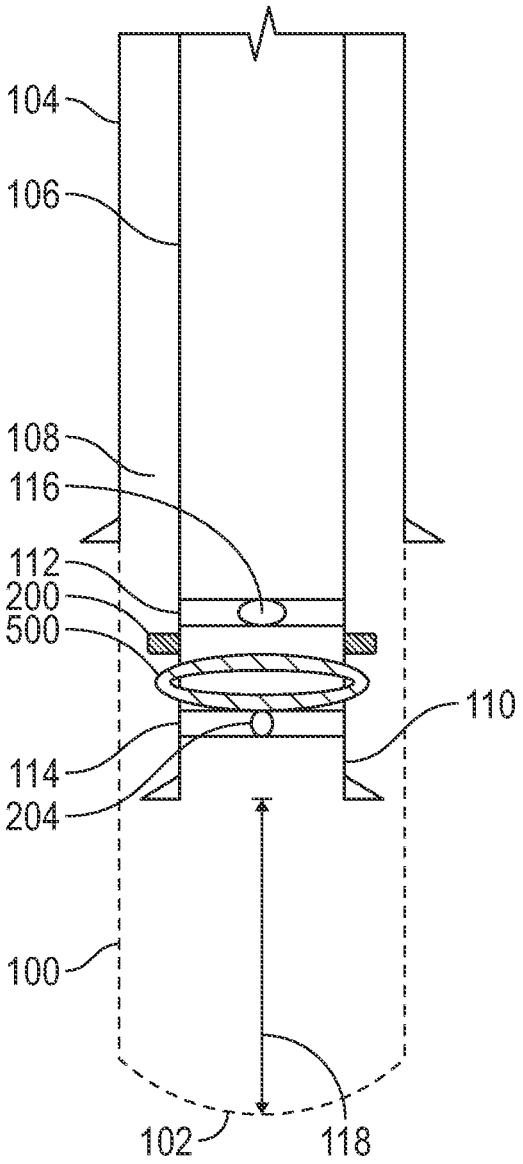
FIGS. 5*a* - 5*d* show an apparatus in accordance with one or more embodiments.

FIG. 5*a* shows the second casing string (106) set off bottom (102). The second casing string (106) has the float collar (112) and the float shoe (114). The float shoe (114) is shown with the controllable port (200) in the closed position. The second casing string (106) further has an expandable packer (500) that is formed in the shape of a ring and goes from the inside of the second casing string (106) to the outside and is located below the controllable port (200). The expandable packer (500) expands laterally when exposed to a chemical (302) activation signal.

The ball seat (204) is fixed within the float shoe (114) and located below the expandable packer (500) and the controllable port (200). The ball seat (204) is configured to receive a ball (206), and, upon reception of the ball (206), fluid is unable to pass through the ball seat. FIG. 5*a* also shows the float shoe (114) having the ball seat (204) with no ball (206) in the ball seat (204) meaning that fluid is free to be pumped from the inside of the second casing string (106) to the open hole (118).

Figure 5B:
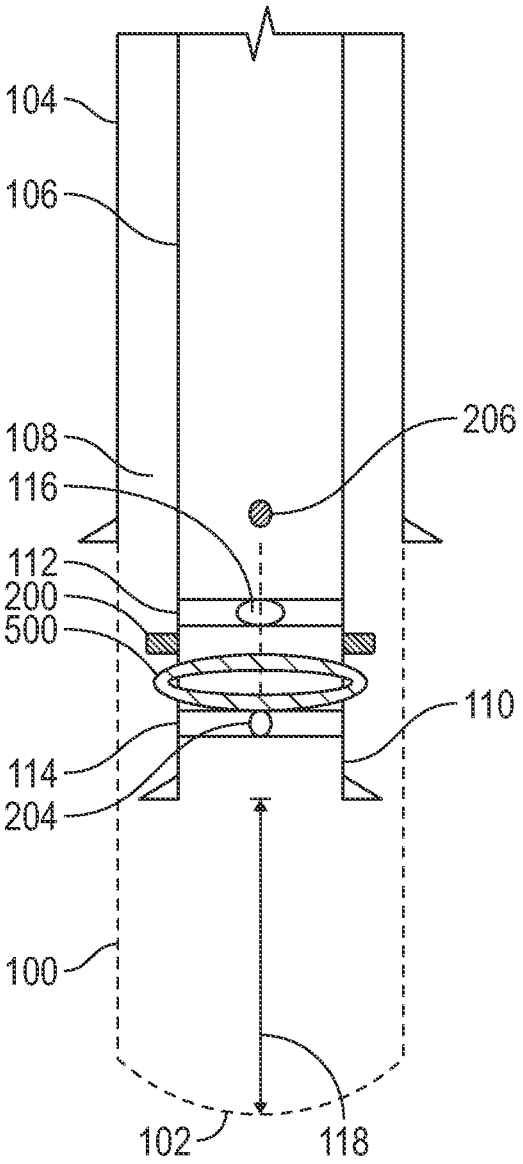
Figure 5C:
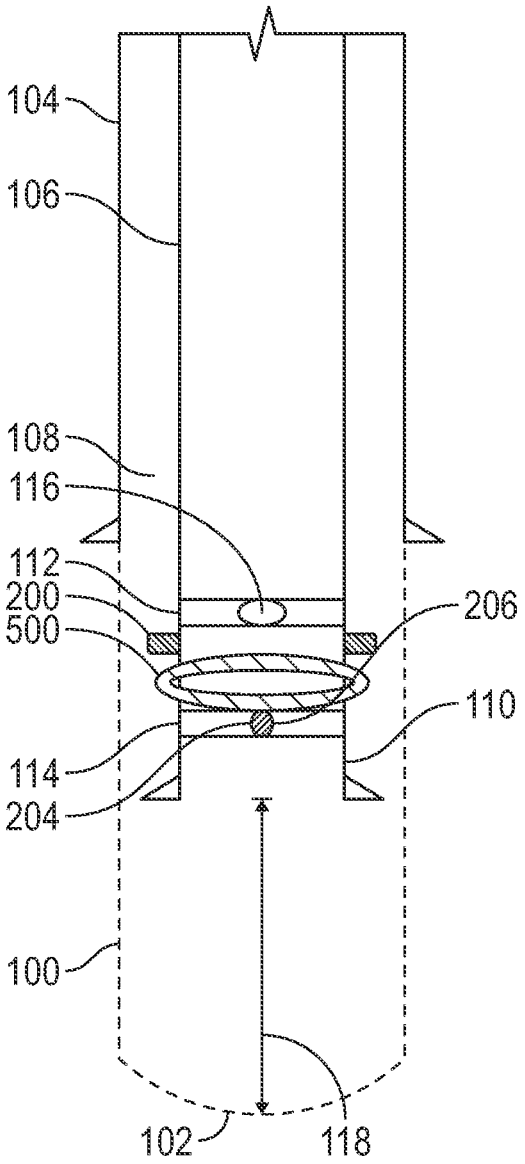
Figure 5D:
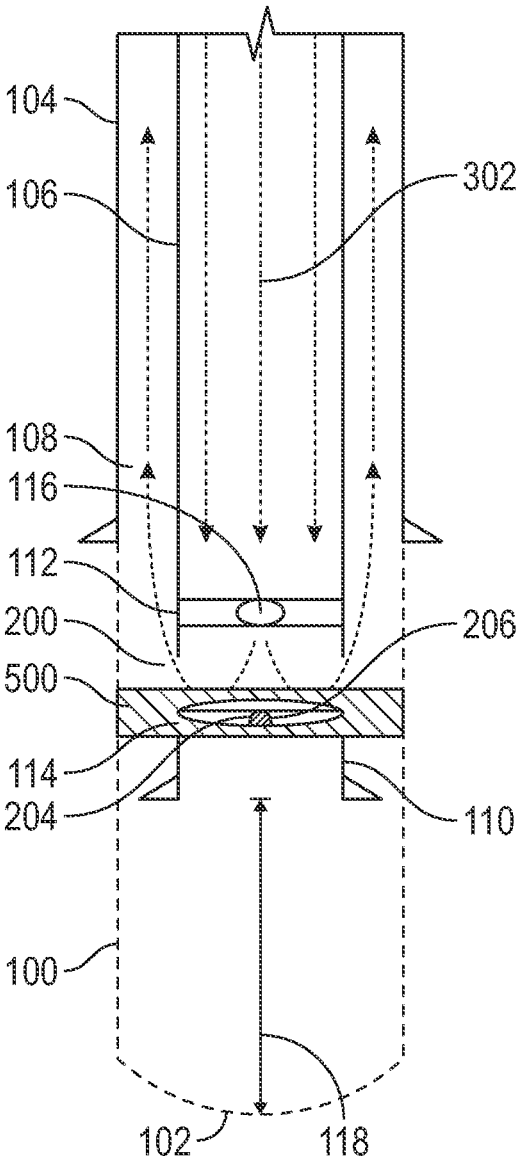

FIG. 5*b* shows a ball (206) being pumped though the inside of the second casing string (106). FIG. 5*c* shows the ball (206) being received and set into the ball seat (204). Once the ball (206) is received in the ball seat (204), fluid pumped into the second casing string (106) has nowhere to go so pressure builds up within the second casing string (106). The fluid that is being pumped into the second casing string to build up the pressure may be a chemical (302) as shown in FIG. 5*d*. The chemical (302) may act as the chemical (302) activation signal to expand the expandable packer (500).

As the pressure builds on top of the ball (206), a second predetermined pressure is reached. This second predetermined pressure shears shear pins (not pictured) located in the controllable port (200). The shearing of the shear pins places the controllable port (200) in the open position and a hydraulic flow path is created between the inside of the second casing string (106) and the annulus (108). Circulation of fluid may be established to confirm that the controllable port (200) is opened.

FIG. 5*d* shows the apparatus after the second predetermined pressure has been reached and the controllable port (200) is open. The expandable packer (500) has also been expanded due to interaction with the chemical (302). At this point, cement (120) may be pumped into the second casing string (106), out of the open controllable port (200) and into the annulus (108). A plug (not pictured) may follow the cement (120) slurry to wipe the cement out of the inside of the second casing string (106). The plug may latch in the float collar (112) or the float shoe (114) to cover the open controllable port (200).

Figure 6A:
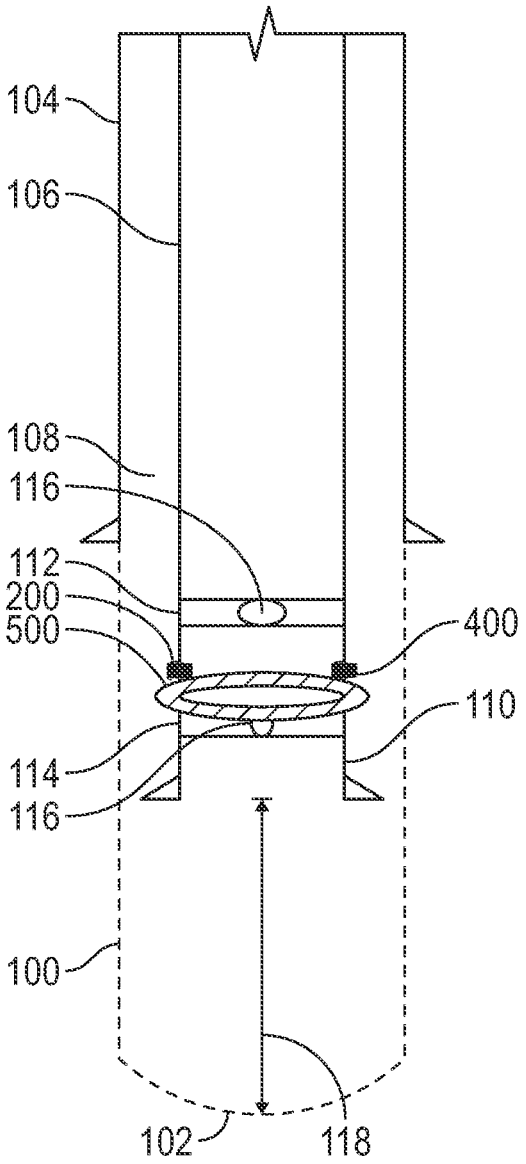
FIGS. 6*a* - 6*b* show an apparatus in accordance with one or more embodiments.
Figure 6B:
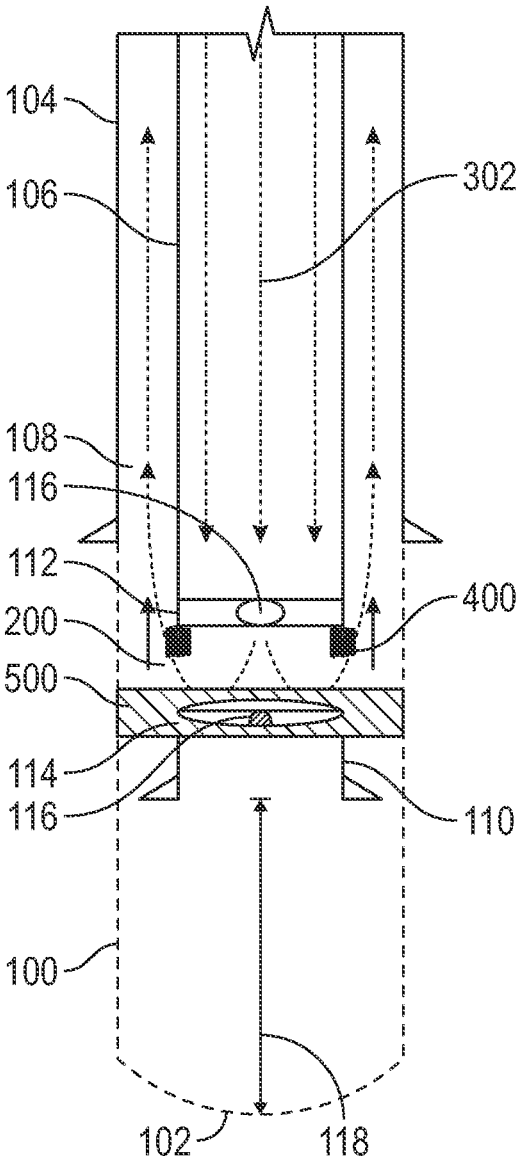

FIGS. 6*a* - 6*b* show an apparatus for off bottom (102) cementing a tubular. Components shown in FIGS. 6*a* - 6*b* that are the same or similar to components shown in FIGS. 1 - 5*d* have not been redescribed for purposes of readability and have the same description and function as described above. The tubular to be cemented is shown as the second casing string (106) but may be any tubular that has been set off bottom (102).

FIG. 6*a* shows the second casing string (106) set off bottom (102). The second casing string (106) has the float collar (112) and the float shoe (114). The float shoe (114) is shown with the controllable port (200) having at least two springs (400). The springs (400) are compressed by an expandable packer (500) keeping the controllable port (200) in the closed position. The expandable packer (500) is formed in the shape of a ring and traverses from the inside of the second casing string (106) to the outside and is located below the controllable port (200). The expandable packer (500) expands laterally when exposed to a chemical (302) activation signal. FIG. 6*a* also shows the float shoe (114) having a float valve (116).

FIG. 6*b* shows a chemical activation signal after being deployed. The chemical activation signal may be a chemical (302) that is pumped into the inside of the second casing string (106). The chemical (302) may act as the chemical (302) activation signal to expand the expandable packer (500). Further, upon the expandable packer (500) being exposed to the chemical (302) activation signal, the springs (400) become uncompressed allowing the controllable port (200) to open which creates a hydraulic flow path between the inside of the second casing string (106) and the annulus (108). Also, upon the chemical (302) being pumped into the well, the float shoe (114) is activated to block the float shoes' (114) float valve (116) to prevent fluid from being pumped from the second casing string (106) to the open hole (118).

Circulation of the chemical (302) may be established to confirm that the controllable port (200) is opened. FIG. 6*b* shows the expandable packer (500) fully expanded and the controllable port (200) opened. At this point, cement (120) may be pumped into the second casing string (106), out of the open controllable port (200) and into the annulus (108). A plug (not pictured) may follow the cement (120) slurry to wipe the cement out of the inside of the second casing string (106). The plug may latch in the float collar (112) or the float shoe (114) to cover the open controllable port (200).

Figure 7A:
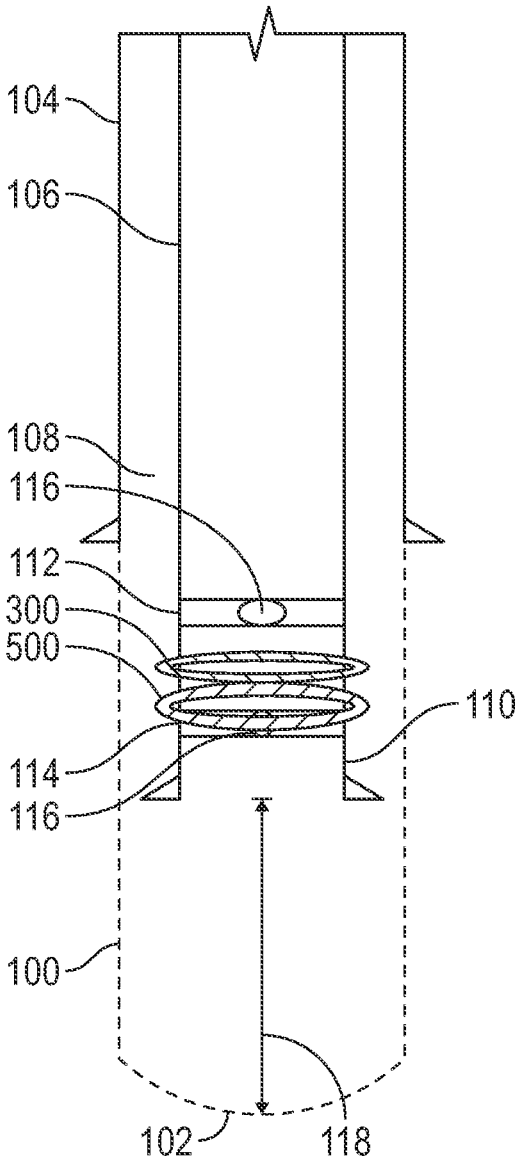
FIGS. 7*a* - 7*b* show an apparatus in accordance with one or more embodiments.
Figure 7B:
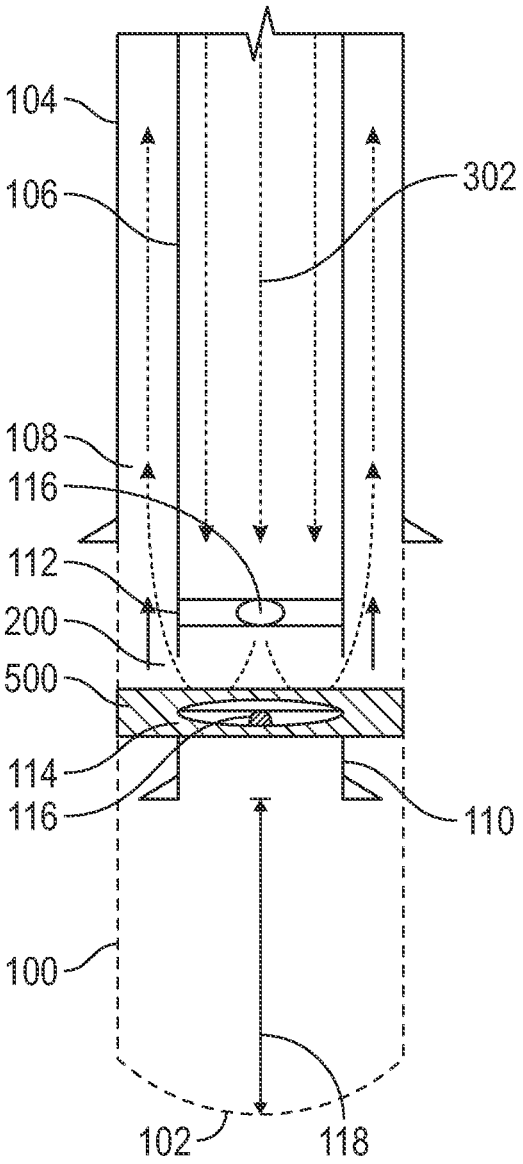
Figure 8:
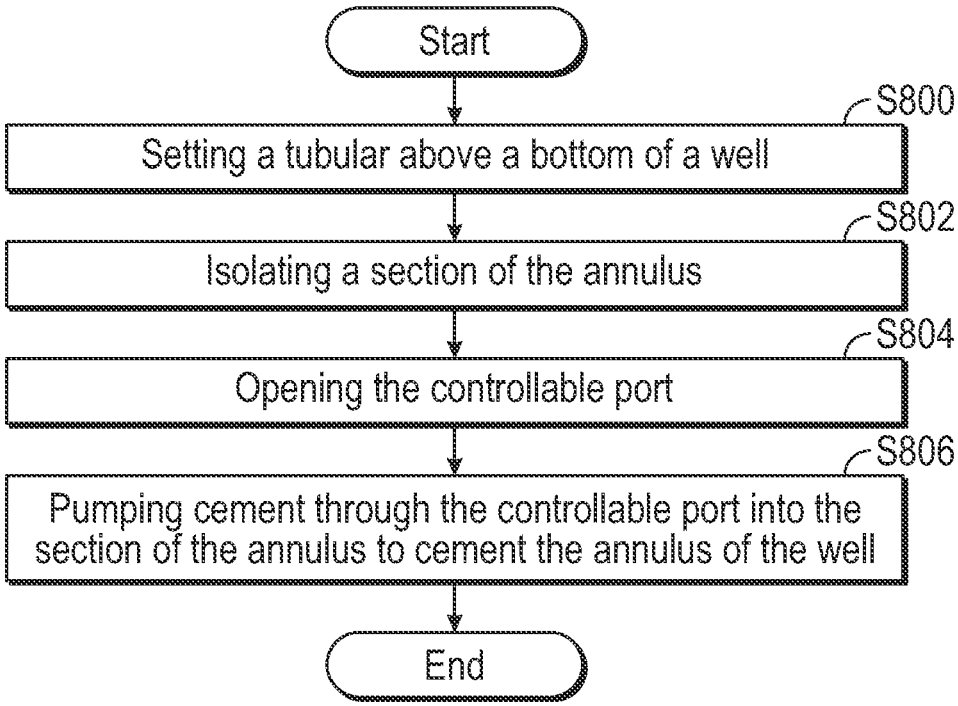
FIG. 8 show a flowchart in accordance with one or more embodiments.

FIGS. 7*a* - 7*b* show an apparatus for off bottom (102) cementing a tubular. Components shown in FIGS. 7*a* - 7*b* that are the same or similar to components shown in FIGS. 1 - 6*b* have not been redescribed for purposes of readability and have the same description and function as described above. The tubular to be cemented is shown as the second casing string (106) but may be any tubular that has been set off bottom (102).

FIG. 7*a* shows the second casing string (106) set off bottom (102). The second casing string (106) has the float collar (112) and the float shoe (114). The float shoe (114) is shown with the controllable port (200) having a dissolvable ring (300). An expandable packer (500) is formed in the shape of a ring and traverses from the inside of the second casing string (106) to the outside and is located below the dissolvable ring (300). The expandable packer (500) expands laterally when exposed to a chemical (302) activation signal. The same chemical activation signal may be used to dissolve the dissolvable ring (300). FIG. 7*a* also shows the float shoe (114) having a float valve (116).

FIG. 7*b* shows the apparatus after the chemical activation signal has been deployed. The chemical activation signal may be a chemical (302) that is pumped into the inside of the second casing string (106), as shown in FIG. 7*b*. The chemical (302) may act as the chemical (302) activation signal to expand the expandable packer (500) and dissolve the dissolvable ring (300). After the dissolvable ring (300) is dissolved, the controllable port (200) is in the open position creating a hydraulic flow path between the inside of the second casing string (106) and the annulus (108). The chemical (302) may also trigger the float shoe (114) to block the float shoes' (114) float valve (116) such that fluid may not pass form the inside of the second casing string (106) to the open hole (118).

At this point, cement (120) may be pumped into the second casing string (106), out of the open controllable port (200) and into the annulus (108). A plug (not pictured) may follow the cement (120) slurry to wipe the cement (120) out of the inside of the second casing string (106). The plug may latch in the float collar (112) or the float shoe (114) to cover the open controllable port (200).

FIG. 8 depicts a flowchart in accordance with one or more embodiments. More specifically, FIG. 8 illustrates a method for cementing an annulus (108) of a well. Further, one or more blocks in FIG. 8 may be performed by one or more components as described in FIGS. 1 - 7*b*. While the various blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a tubular is set above a bottom (102) of a well (S800). The well may include a first casing string (104) set to a particular depth and a wellbore (100) drilled past the first casing string (104). The tubular may be a second casing string (106) that is set to a depth off bottom (102) of the wellbore (100). The second casing string (106) includes a float shoe (114) that is attached to a distal end (110) of the second casing string (106). A controllable port (200) having an open position and a closed position penetrates the wall of the float shoe (114). A ball seat (204) may be fixed within the float shoe (114) and may be located beneath the controllable port (200). The float shoe (114) may have a float valve (116) An annulus (108) is located around the outside of the second casing string (106).

A ball (206) may be pumped into the ball seat (204) to prevent fluid from passing through the ball seat (204). Fluid may be pumped on the ball (206) while the ball (206) is in the ball seat (204). This causes pressure to build up within the second casing string (106). A section of the annulus (108) is isolated (S802). The section of the annulus (108) may be isolated by pushing a sleeve into a wellbore (100) in response to an activation signal. The sleeve (202) may be located beneath the ball seat (204) along the distal end (110) of the second casing string (106). The activation signal may include a first predetermined pressure being reached by pumping fluid on the ball (206) in the ball seat (204). The activation signal may also be a dissolvable ring (300) being dissolved by a chemical (302). When the dissolvable ring (300) is dissolved, springs (400) release the sleeve (202) and push the sleeve (202) into the wellbore (100).

The section of the annulus (108) may be isolated by exposing an expandable packer (500) to a chemical (302) activation signal. The expandable packer (500) may be located between the ball seat (204) and the controllable port (200) or between the float valve (116) and the controllable port (200). The expandable packer (500) has hydraulic access to the inside of the second casing string (106), but also expands in a lateral direction away from the second casing string (106) into the annulus (108) to isolate a section of the annulus (108) from the open hole (118) section beneath the second casing string (106).

The controllable port (200) is opened (S804). The controllable port (200) may be opened by applying a second predetermined pressure on the ball (206) to shear shear pins. Once the shear pins are sheared, the controllable port (200) may open to the annulus (108), thus creating hydraulic communication between the inside of the second casing string (106) and the annulus (108). The second predetermined pressure is higher than the first predetermined pressure such that the section of the annulus (108) is isolated prior to the controllable port (200) opening.

The controllable port may also have a dissolvable ring (300). The dissolvable ring (300) is designed to dissolve in the presence of a chemical (302) such as the chemical (302) activation signal that activates the expandable packer (500). When the dissolvable ring (300) dissolves, the controllable port (200) is opened. In other embodiments, the controllable port (200) may include springs (400). The springs (400) may be compressed by the expandable packer (500) keeping the controllable port (200) in the closed position. Upon expansion of the expandable packer (500), the springs (400) may open the controllable port (200). When the chemical (302) is pumped into the second casing string (106) the chemical (302) may be free to reach the float shoe (114) due to fluid being able to pass through the float shoe's (114) float valve (116). When the chemical (302) reaches the float shoe (114), the float shoe (114) may activate to block the float shoe's (114) float valve (116), thus preventing fluid from passing from the inside of the second casing string (106) to the open hole (102).

After the annulus (108) is isolated from the open hole (118) be either the sleeve (202) or the expandable packer (500) and the controllable port (200) is opened, cement (120) is pumped through the controllable port (200) into the section of the annulus (108) to cement the annulus (108) of the well (S806). A plug may follow the cement (120) slurry to wipe the cement (120) out of the inside of the second casing string (106). The plug may latch in the float collar (112) or the float shoe (114) to cover the open controllable port (200). The cement (120) may be left to set and harden, thus cementing the second casing string (106) (i.e., the tubular) in place.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. An apparatus for off-bottom cementing of a tubular, the apparatus comprising:

a float shoe attached to a distal end of the tubular;

a controllable port penetrating a wall of the float shoe, wherein the controllable port further comprises a dissolvable ring made of a material that dissolves when exposed to a chemical activation signal; and a sleeve mounted at a position, below the controllable port, on an exterior surface of the float shoe and comprising a spring that responds to an activation signal to push the sleeve into the wellbore to isolate an annulus, wherein the activation signal is the dissolvable ring being dissolved, wherein the controllable port has an open position that allows cement to be pumped from an inside of the tubular to the annulus to cement the tubular in place.

2. The apparatus of claim 1, further comprising:

a ball seat fixed within the float shoe and located between the sleeve and the controllable port, wherein the ball seat is configured to receive a ball.

3. The apparatus of claim 1, wherein, upon the dissolvable ring being dissolved, the controllable port opens to create a hydraulic flow path between the inside of the tubular and the annulus of the tubular.

4. An apparatus for off-bottom cementing of a tubular, the apparatus comprising:

a float shoe attached to a distal end of the tubular;

a controllable port penetrating a wall of the float shoe; and an expandable packer mounted at a position on an exterior surface of the float shoe, below the controllable port, wherein the expandable packer expands when exposed to a chemical activation signal, wherein the controllable port has an open position that allows cement to be pumped from an inside of the tubular to an annulus of the tubular to cement the tubular in place, and wherein, upon the expandable packer being exposed to the chemical activation signal, a spring is activated to open the controllable port and create a hydraulic flow path between the inside of the tubular and the annulus of the tubular.

5. The apparatus of claim 4, further comprising:

a ball seat fixed within the float shoe and located below the expandable packer and the controllable port, wherein the ball seat is configured to receive a ball, and, upon reception of the ball, fluid is pumped on the ball.

6. A method for cementing an annulus of a well, the method comprising:

setting a tubular above a bottom of the well, the tubular comprising:

a float shoe attached to a distal end of the tubular; and a controllable port penetrating a wall of the float shoe;

isolating a section of the annulus by exposing an expandable packer to a chemical activation signal;

opening the controllable port by exposing the expandable packer to the chemical activation signal to activate a springs; and pumping cement through the controllable port into the section of the annulus to cement the annulus of the well.

7. The method of claim 6, further comprising:

pumping a ball into a ball seat of the tubular to prevent fluid from passing through the ball.

* * * * *